US011148861B1

(12) United States Patent
Chen

(10) Patent No.: US 11,148,861 B1
(45) Date of Patent: Oct. 19, 2021

(54) TOOL DISPLAY BOARD

(71) Applicant: MING SHIN TOOLS CO., LTD., Taichung (TW)

(72) Inventor: Yung-Shun Chen, Taichung (TW)

(73) Assignee: MING SHIN TOOLS CO., LTD., Taichung (TW)

( * ) Notice: Subject to any disclaimer, the term of this patent is extended or adjusted under 35 U.S.C. 154(b) by 0 days.

(21) Appl. No.: 16/897,892

(22) Filed: Jun. 10, 2020

(51) Int. Cl.
*B65D 85/28* (2006.01)
*B65D 73/00* (2006.01)

(52) U.S. Cl.
CPC ..... *B65D 73/0035* (2013.01); *B65D 73/0014* (2013.01)

(58) Field of Classification Search
CPC ..... B65D 73/0035; B65D 73/0014; B25B 13/56; B25H 3/00
USPC ..... 206/372, 373, 376, 378, 483, 806, 807; 211/70.6
See application file for complete search history.

(56) References Cited

U.S. PATENT DOCUMENTS 7,264,213 B2 * 9/2007 Liu ..... A47F 5/0006 206/378
7,527,150 B2 * 5/2009 Tong ..... A47F 7/024 206/376
8,302,772 B2 * 11/2012 Chang ..... B65D 25/22 206/379
8,387,792 B2 * 3/2013 Chen ..... B65D 85/20 206/378
8,550,244 B1 * 10/2013 Ou ..... B25H 3/003 206/378
8,727,118 B1 * 5/2014 Chen ..... B25H 3/003 206/372
8,800,767 B2 * 8/2014 Wang ..... B25H 3/00 206/372
2015/0183573 A1 * 7/2015 Chao-Ming ..... B25H 3/003 206/378

FOREIGN PATENT DOCUMENTS

TW M520445 U 4/2016

* cited by examiner

*Primary Examiner* — Luan K Bui
(74) *Attorney, Agent, or Firm* — Muncy, Geissler, Olds & Lowe, P.C.

(57) ABSTRACT

A tool display board is provided, including: a main body, including a plurality of receiving portions arranged along a first direction, each said receiving portion being configured for receiving a socket, the plurality of receiving portions including at least one insertion member, inner faces of distal two of the plurality of receiving portions on the first direction respectively including a first engagement portion; and a holding member, including a circumferential wall and an upper wall, the circumferential wall being engaged within at least part of the plurality of receiving portions, the upper wall including at least one second engagement portion blockably engaged with the at least one insertion member, the circumferential wall including two third engagement portions arranged on the first direction, each of the two third engagement portions being blockably engaged with one said first engagement portion.

9 Claims, 6 Drawing Sheets

TOOL DISPLAY BOARD

BACKGROUND OF THE INVENTION

Field of the Invention

The present invention relates to a tool display board.

Description of the Prior Art

The conventional tool display board, such as one disclosed in TWM520445, is used for storing and displaying a plurality of sockets. In TWM520445, positioning member(s) and portion(s) of a main body are sleeved around or inserted into respective ends of the socket(s), and the positioning member(s) is/are fixed to the main body by locking or fastening member(s). As a result, consumers can see the appearance of the socket(s), and it is anti-thief.

However, the assembly process of the above-mentioned conventional tool display board is inconvenient, time-consuming and labor-consuming since the positioning member(s) is/are fixed to the main body by locking or fastening member(s). In addition, the tool display board provided with the positioning member(s) is of high manufacturing cost.

The present invention is, therefore, arisen to obviate or at least mitigate the above-mentioned disadvantages.

SUMMARY OF THE INVENTION

The main object of the present invention is to provide a tool display board which is anti-thief, has a simple structure, and is of low cost.

To achieve the above and other objects, a tool display board is provided, including: a main body, including a plurality of receiving portions arranged along a first direction, each said receiving portion being configured for receiving a socket, the plurality of receiving portions including at least one insertion member, inner faces of distal two of the plurality of receiving portions on the first direction respectively including a first engagement portion; and a holding member, including a circumferential wall and an upper wall, the circumferential wall being engaged within at least part of the plurality of receiving portions, the upper wall including at least one second engagement portion blockably engaged with the at least one insertion member, the circumferential wall including two third engagement portions arranged on the first direction, each of the two third engagement portions being blockably engaged with one said first engagement portion.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
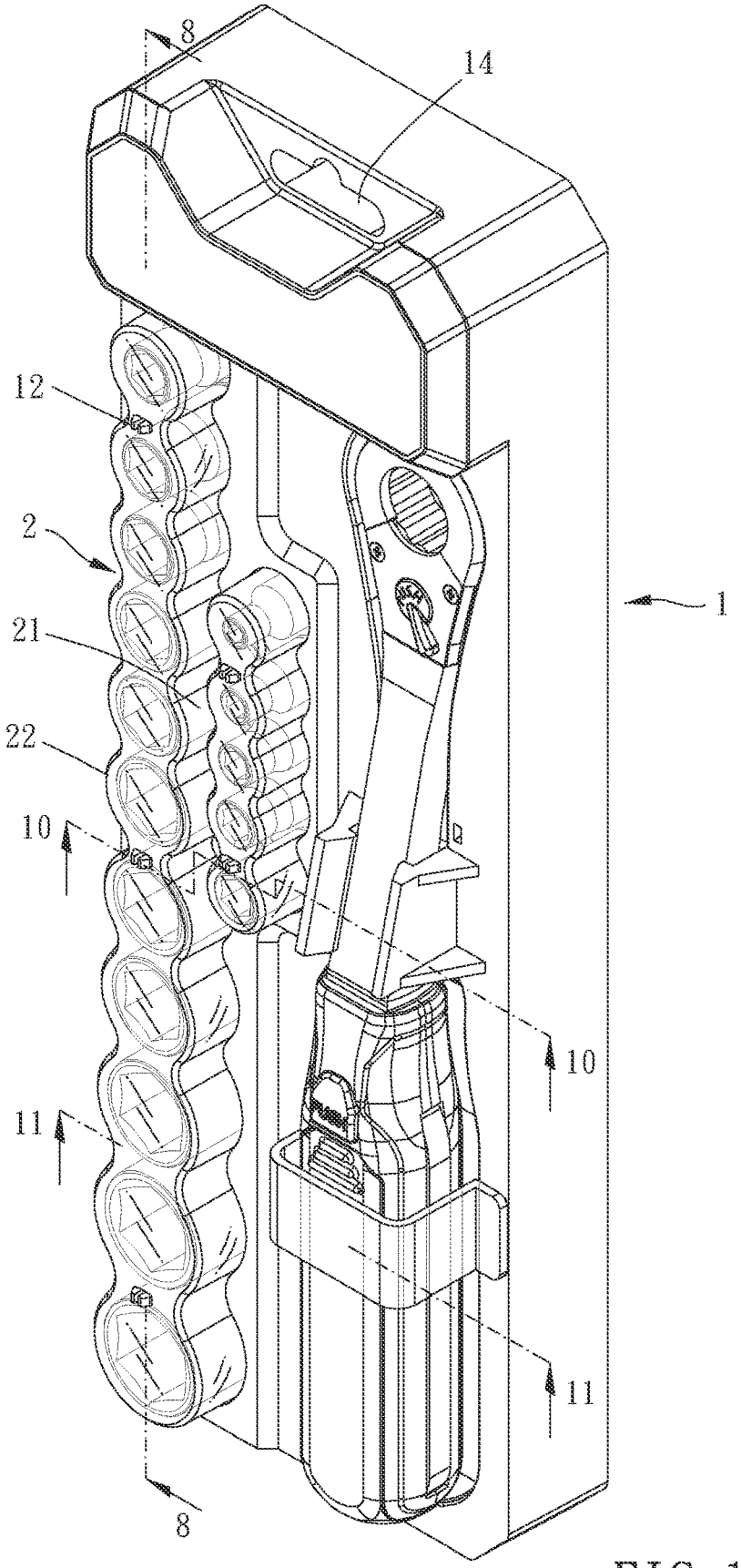
FIG. 1 is a stereogram of a preferable embodiment of the present invention.
Figure 2:
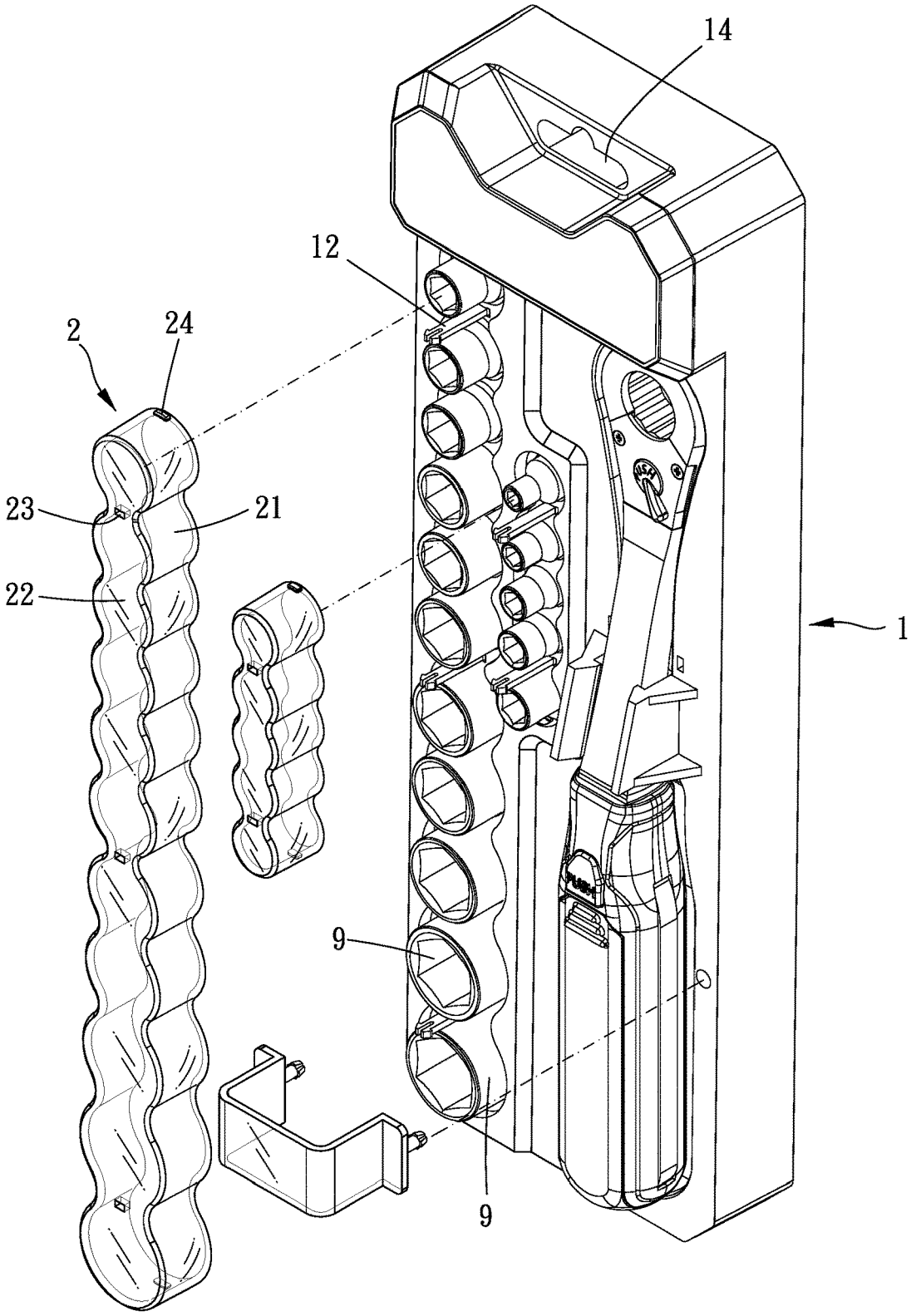
FIGS. 2-4 are breakdown drawings of a preferable embodiment of the present invention.
Figure 3:
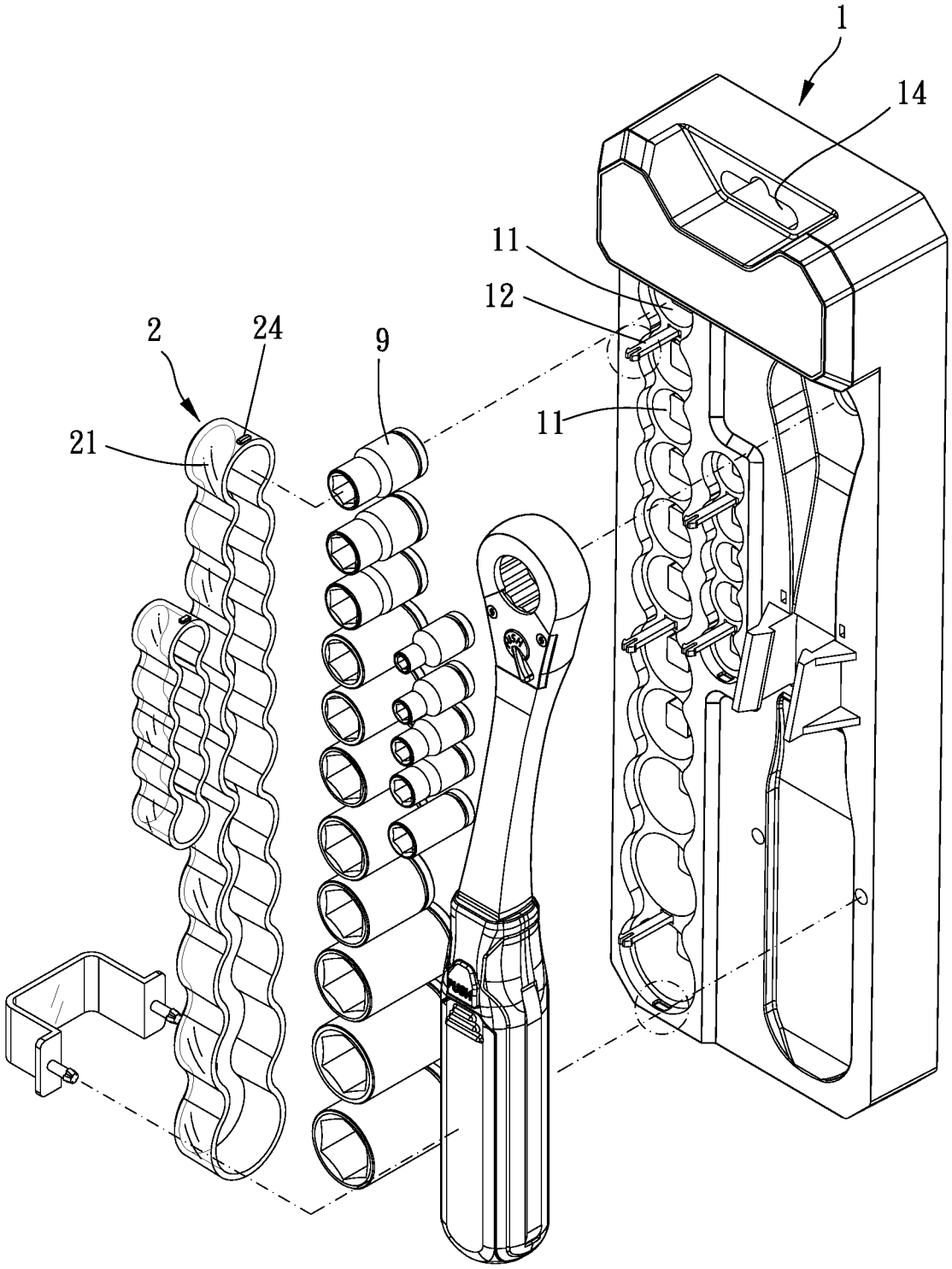
Figures 4, 5, 6, 7:
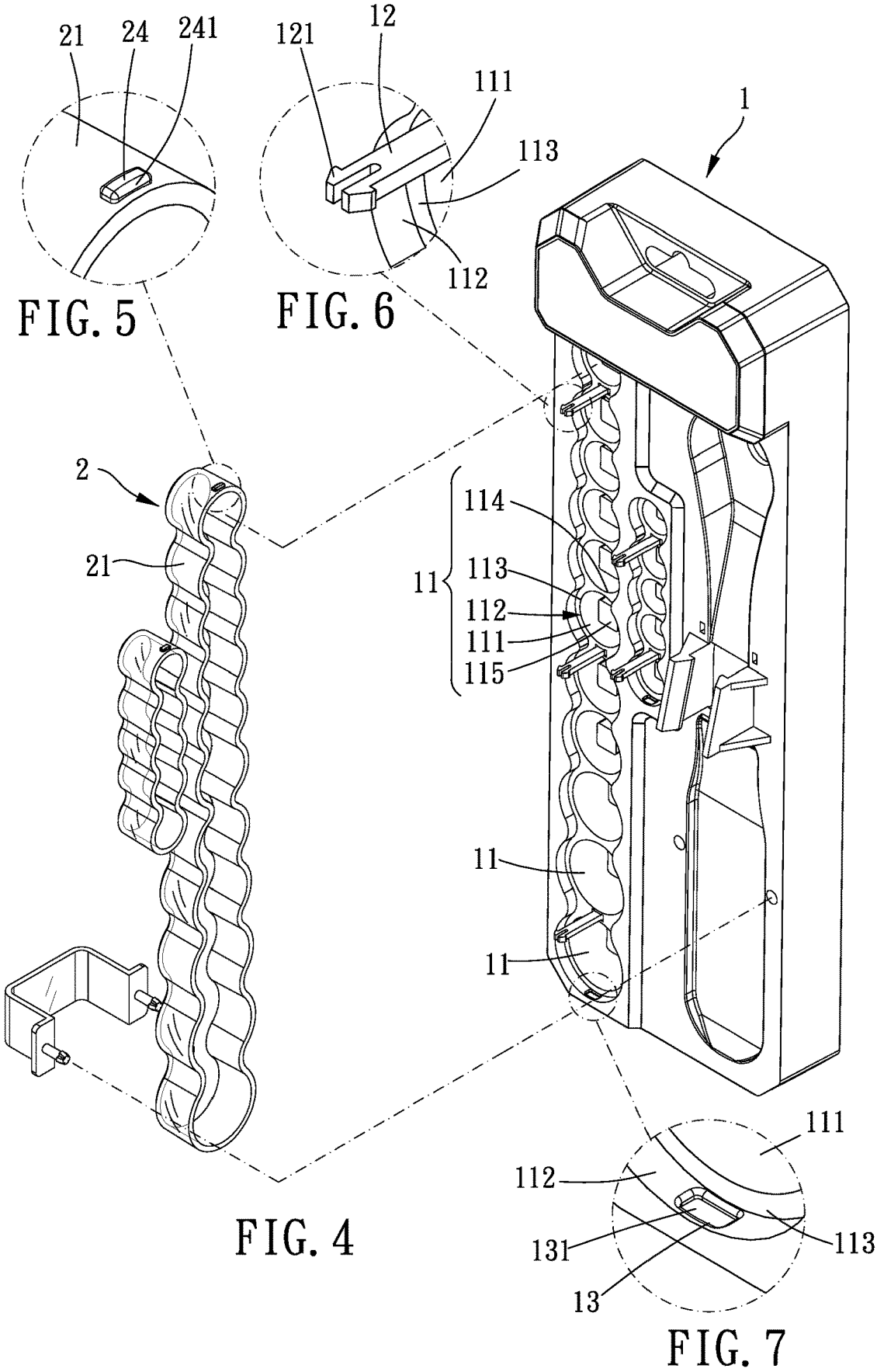
FIGS. 5-7 are partial enlargements of a preferable embodiment of the present invention.
Figure 9:
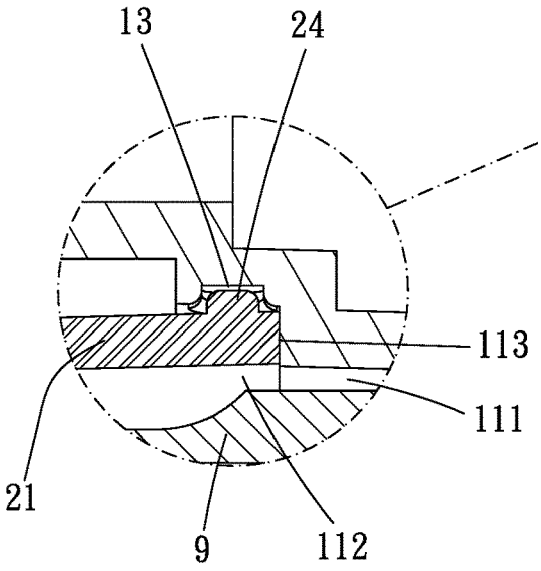
FIG. 9 is a partial enlargement of FIG. 8.
Figure 8:
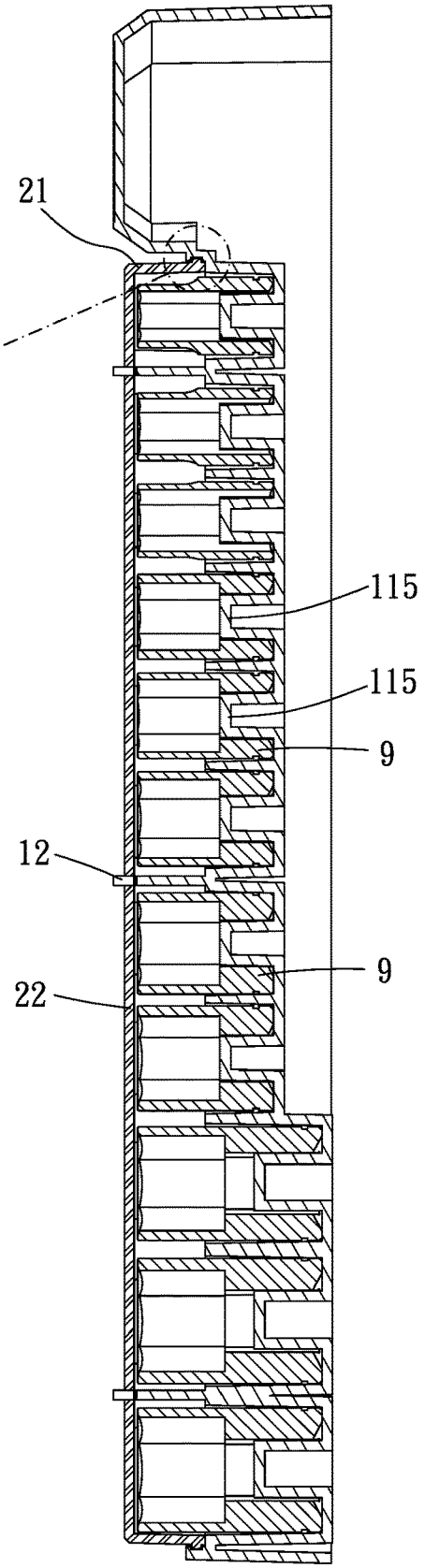
FIG. 8 is a cross-sectional view, taken along line 8-8 in FIG. 1, according to a preferable embodiment of the present invention.
Figure 10:
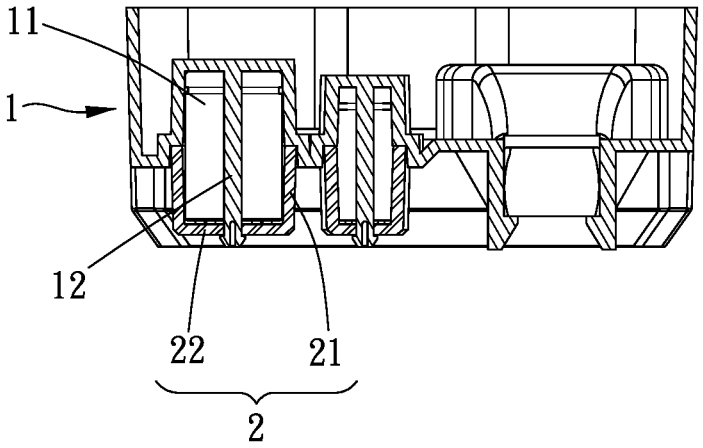
FIG. 10 is a cross-sectional view, taken along line 10-10 in FIG. 1, according to a preferable embodiment of the present invention.
Figure 11:
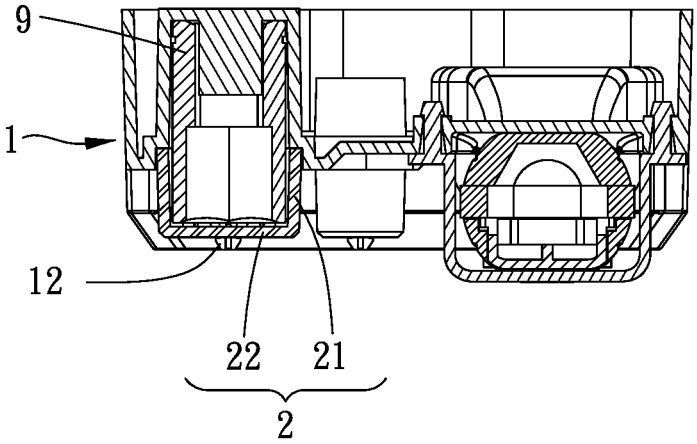
FIG. 11 is a cross-sectional view, taken along line 11-11 in FIG. 1, according to a preferable embodiment of the present invention.

Please refer to FIGS. 1 to 11 for a preferable embodiment of the present invention. A tool display board 1 of the present invention includes a main body 1 and a holding member 2.

The main body 1 includes a plurality of receiving portions 11 arranged along a first direction, each said receiving portion 11 is configured for receiving a socket 9, and the plurality of receiving portions 11 includes at least one insertion member 12. In this embodiment, the plurality of receiving portions 11 includes a plurality of insertion members 12. Inner faces of distal two of the plurality of receiving portions 11 on the first direction respectively include a first engagement portion 13. In this embodiment, the main body 1 further includes a hanging portion 14 on one side thereof in the first direction for hanging on a rack, wall or the like.

The holding member 2 includes a circumferential wall 21 and an upper wall 22, the circumferential wall 21 is engaged within at least part of the plurality of receiving portions 11, and the upper wall 22 includes at least one second engagement portion 23 blockably engaged with the at least one insertion member 12. In this embodiment, a number of the at least one second engagement portion 23 is equal to a number of the plurality of insertion members 12, and each said second engagement portion 23 is blockably engaged with one said insertion member 12. The circumferential wall 21 includes two third engagement portions 24 arranged on the first direction, and each of the two third engagement portions 24 is blockably engaged with one said first engagement portion 13. Whereby, since the plurality of insertion members 12 and the plurality of second engagement portions 23 are blockably engaged with each other, respectively, thus preventing detachment of the holding member 2 from the main body 1; the circumferential wall 21 is blockably engaged within the plurality of receiving portions 11, thus preventing rocking of the holding member 2 relative to the main body 1. As a result, it is anti-theft. Furthermore, the tool display board 1 has a simple structure, and is easy to assemble and of low production cost.

Specifically, each said receiving portion 11 includes a first space 111 configured for receiving the socket 9 and a second space 112 enlarged with respect to the first space 111, and the second spaces 112 of the plurality of receiving portions 11 are communicated with each other. The first space 111 is configured for receiving the socket 9, and the second spaces 112 are configured for receiving the circumferential wall 21 of the holding member 2. Between the second space 112 and the first space 111 is a stepped portion 113 on which the circumferential wall 21 is abutted, thus enhancing the structural strength. However, there may be none of stepped portion provided between the second space and the first space.

Preferably, between every neighboring two of the plurality of receiving portions 11 is a partition 114, and each said insertion member 12 is protrudingly disposed on one said partition 114, wherein the partition 114 can prevent rocking of the socket 9, prevent collision of the socket 9 with the insertion member 12, prevent disengagement of the insertion member 12 from the second engagement portion 23.

In this embodiment, each said first space 111 includes a projection 115 which is disposed on a bottom side thereof and configured to be inserted into the socket 9. Preferably, each said projection is polygonal, which can prevent rotation of the socket 9 relative to the projection 115.

Preferably, each said first engagement portion 13 is disposed on an inner face of one said second space 112, and a connection between the first engagement portions 13 is parallel to the first direction.

Specifically, contours of the plurality of second spaces 112 are connected in a wave-shaped manner, and the circumferential wall 21 is wave-shaped and has a contour corresponding to the contours of the plurality of second spaces 112, which provides a structure corresponding to a contour of the socket 9.

Preferably, each said insertion member 12 includes a hook portion 121 at an end thereof remote from the main body 1, each said second engagement portion 23 is an insertion hole disposed through the upper wall 22, and the hook portion 121 is inserted into the insertion hole and blockably engaged with the upper wall 22. To detach the holding member 2, the hook portion 121 should be broken so that the holding member 2 can be detached from the insertion member 12 and the main body 1.

In this embodiment, the holding member 2 is a blister, which is of low cost.

One of the first engagement portion 13 and the third engagement portion 24 is a protrusion 241, the other one of the first engagement portion 13 and the third engagement portion 24 is a recession 131. Preferably, each said first engagement portion 13 is a recession 131, and each said third engagement portion 24 is a protrusion 241 blockably engaged within the recession 131. It is noted that each said first engagement portion may be a protrusion, and each said third engagement portion is a recession.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A tool display board, including:

a main body, including a plurality of receiving portions arranged along a first direction, each said receiving portion being configured for receiving a socket, the plurality of receiving portions including at least one insertion member, inner faces of distal two of the plurality of receiving portions on the first direction respectively including a first engagement portion; and a holding member, including a circumferential wall and an upper wall, the circumferential wall being engaged within at least part of the plurality of receiving portions, the upper wall including at least one second engagement portion blockably engaged with the at least one insertion member, the circumferential wall including two third engagement portions arranged on the first direction, each of the two third engagement portions being blockably engaged with one said first engagement portion;

wherein each said receiving portion includes a first space configured for receiving the socket and a second space enlarged with respect to the first space, and the second spaces of the plurality of receiving portions are communicated with each other and receiving the circumferential wall of the holding member.

2. The tool display board of claim 1, wherein between the second space and the first space of each said receiving portion is a stepped portion on which the circumferential wall is abutted.

3. The tool display board of claim 1, wherein between every neighboring two of the plurality of receiving portion is a partition, and each said insertion member is protrudingly disposed on one said partition.

4. The tool display board of claim 1, wherein each said first space includes a projection which is disposed on a bottom side thereof and configured to be inserted into the socket.

5. The tool display board of claim 2, wherein each said first engagement portion is disposed on an inner face of one said second space.

6. The tool display board of claim 2, wherein contours of the plurality of second spaces are connected in a wave-shaped manner, and the circumferential wall is wave-shaped and has a contour corresponding to the contours of the plurality of second space.

7. The tool display board of claim 1, wherein each said insertion member includes a hook portion, each said second engagement portion is an insertion hole disposed through the upper wall, and the hook portion is inserted into the insertion hole and blockably engaged with the upper wall.

8. The tool display board of claim 1, wherein the holding member is a blister, one of the first engagement portion and the third engagement portion is a protrusion, the other one of the first engagement portion and the third engagement portion is a recession, and each said protrusion is engaged within one said recession.

9. The tool display board of claim 6, wherein between every neighboring two of the plurality of receiving portion is a partition, and each said insertion member is protrudingly disposed on one said partition; each said first space includes a projection which is disposed on a bottom side thereof and configured to be inserted into the socket; each said first engagement portion is disposed on an inner face of one said second space; each said insertion member includes a hook portion, each said second engagement portion is an insertion hole disposed through the upper wall, and the hook portion is inserted into the insertion hole and blockably engaged with the upper wall; the holding member is a blister, one of the first engagement portion and the third engagement portion is a protrusion, the other one of the first engagement portion and the third engagement portion is a recession, and each said protrusion is engaged within one said recession; each said projection is polygonal; the main body further includes a hanging portion on one side thereof in the first direction; and a connection between the first engagement portions of the inner faces of the distal two of the plurality of receiving portions is parallel to the first direction.

* * * * *